US009452339B1

(12) United States Patent
Shah et al.

(10) Patent No.: US 9,452,339 B1
(45) Date of Patent: Sep. 27, 2016

(54) AUTOMATED BALL LAUNCHING SYSTEM

(71) Applicant: LILA ATHLETICS INC., Brampton (CA)

(72) Inventors: Paulom Shah, Brampton (CA); Aya Siblini, Kitchener (CA); Kevin Vijay Brijbassi, Brampton (CA); Joseph Arthur Schipper, Kitchener (CA); Saleem Adil Mohammed, Mississauga (CA)

(73) Assignee: LILA ATHLETICS INC., Brampton (CA)

( * ) Notice: Subject to any disclaimer, the term of this patent is extended or adjusted under 35 U.S.C. 154(b) by 0 days.

(21) Appl. No.: 14/750,515

(22) Filed: Jun. 25, 2015

(51) Int. Cl.
*A63B 69/40* (2006.01)
*F41B 4/00* (2006.01)

(52) U.S. Cl.
CPC ..... *A63B 69/406* (2013.01); *A63B 69/40* (2013.01); *F41B 4/00* (2013.01); *A63B 2069/401* (2013.01); *A63B 2069/402* (2013.01)

(58) Field of Classification Search
CPC ..... A63B 69/0071; A63B 2063/001; A63B 69/40; A63B 63/083; A63B 69/406; A63B 2024/0037; A63B 69/0002; A63B 2069/0008; A63B 2069/401; A63B 2069/402; A63B 47/002
USPC ..... 124/54, 78, 6, 81; 473/422, 431, 433, 473/436, 451
See application file for complete search history.

(56) References Cited

U.S. PATENT DOCUMENTS 4,442,823 A * 4/1984 Floyd ..... A63B 69/406 124/41.1
4,579,340 A * 4/1986 Jenkins ..... A63B 63/083 124/3
4,596,230 A * 6/1986 Griffith ..... A63B 69/406 124/50
4,678,189 A * 7/1987 Koss ..... A63B 69/0071 124/50
4,714,248 A * 12/1987 Koss ..... A63B 69/0071 124/78
5,464,208 A * 11/1995 Pierce ..... A63B 69/406 124/78
5,465,978 A * 11/1995 Magnone ..... A63B 69/0024 124/7

(Continued)

OTHER PUBLICATIONS

Airborne Athletics, Inc. "Dr. Dish Owners Manual" pp. 1-28; downloaded Oct. 1, 2015 from https://drdishbasketball.com/wp-content/uploads/2015/03/Current-Dr.-Dish-Manual.pdf.

*Primary Examiner* — Alexander Niconovich
(74) *Attorney, Agent, or Firm* — Perry + Currier Inc.; Kristjan Spence

(57) ABSTRACT

An automated ball launching system is described. The system includes a ball support configured to releasably support a ball in a launch position; a positioning subsystem configured to set a launch direction for the ball; a launcher configured to project the ball in the launch direction from the launch position; and a control subsystem connected to the positioning subsystem and the launcher. The control subsystem is configured to: determine a position of a player relative to the ball launching system; control the positioning subsystem to set the launch direction based on the position of the player; and control the launcher to project the ball in the launch direction.

17 Claims, 10 Drawing Sheets

(56) References Cited

U.S. PATENT DOCUMENTS 5,487,540 A * 1/1996 Bixler ..... A63B 69/0071 473/436
5,647,338 A * 7/1997 Martin ..... A63B 69/409 124/73
5,681,230 A * 10/1997 Krings ..... A63B 69/0071 124/26
5,776,018 A * 7/1998 Simpson ..... A63B 24/0021 473/433
5,897,445 A * 4/1999 Sanders ..... A63B 24/0003 473/421
6,102,021 A * 8/2000 Sanders ..... A63B 24/0003 124/78
6,152,126 A * 11/2000 Smith ..... A63B 69/0002 124/78
6,241,628 B1 * 6/2001 Jenkins ..... A63B 69/0071 124/6
6,443,140 B1 * 9/2002 Crews ..... A63B 47/00 124/78
6,470,873 B2 * 10/2002 Battersby ..... A63B 69/406 124/78
6,513,512 B2 * 2/2003 Battersby ..... A63B 69/406 124/78
6,539,931 B2 * 4/2003 Trajkovic ..... A63B 24/00 124/32
6,546,924 B2 * 4/2003 Battersby ..... A63B 69/406 124/78
6,776,732 B2 * 8/2004 Parkinson ..... A63B 69/406 124/34
7,082,938 B2 * 8/2006 Wilmot ..... A63B 69/406 124/78
7,111,620 B2 * 9/2006 Johndreau ..... A63B 69/406 124/45
7,553,244 B2 * 6/2009 York ..... A63B 69/00 124/78
7,927,237 B2 * 4/2011 Jenkins ..... A63B 69/0071 473/431
7,938,746 B2 * 5/2011 Chipperfield ..... A63B 24/0021 473/434
8,123,634 B1 * 2/2012 Lovett ..... A63B 63/083 473/433
8,206,246 B2 * 6/2012 Joseph ..... A63B 24/0075 473/422
8,845,460 B1 * 9/2014 Feldstein ..... A63B 69/0071 473/433
9,010,309 B2 * 4/2015 Lewis ..... A63B 69/40 124/4
9,017,188 B2 * 4/2015 Joseph ..... A63B 24/0075 473/422
9,022,016 B1 * 5/2015 Hafer ..... F41B 4/00 124/6
9,233,292 B2 * 1/2016 Joseph ..... A63B 69/40
2002/0134367 A1 * 9/2002 Delso ..... F41B 4/00 124/82
2013/0104870 A1 * 5/2013 Rizzo ..... A63B 69/40 124/78

* cited by examiner

AUTOMATED BALL LAUNCHING SYSTEM

FIELD

The specification relates generally to ball sports, and specifically to an automated ball launching system for launching balls or other projectiles.

BACKGROUND

Participants in various sports, including ball sports such as basketball, can improve their performance by training skills such as shooting (e.g. at a net). Without any assistance from other participants, such training can be rendered inefficient by the frequent need to collect balls for further training shots. Current systems intended to aid the collection of balls and their return to the training participant, however, require extensive configuration to operate, and remain inefficient, at least in part due to their lack of operational flexibility.

SUMMARY

According to an aspect of the specification, an automated ball launching system is provided. The system includes a ball support configured to releasably support a ball in a launch position; a positioning subsystem configured to set a launch direction for the ball; a launcher configured to project the ball in the launch direction from the launch position; and a control subsystem connected to the positioning subsystem and the launcher. The control subsystem is configured to: determine a position of a player relative to the ball launching system; control the positioning subsystem to set the launch direction based on the position of the player; and control the launcher to project the ball in the launch direction.

BRIEF DESCRIPTIONS OF THE DRAWINGS

Embodiments are described with reference to the following figures, in which.

DETAILED DESCRIPTION OF THE EMBODIMENTS

Figure 1:
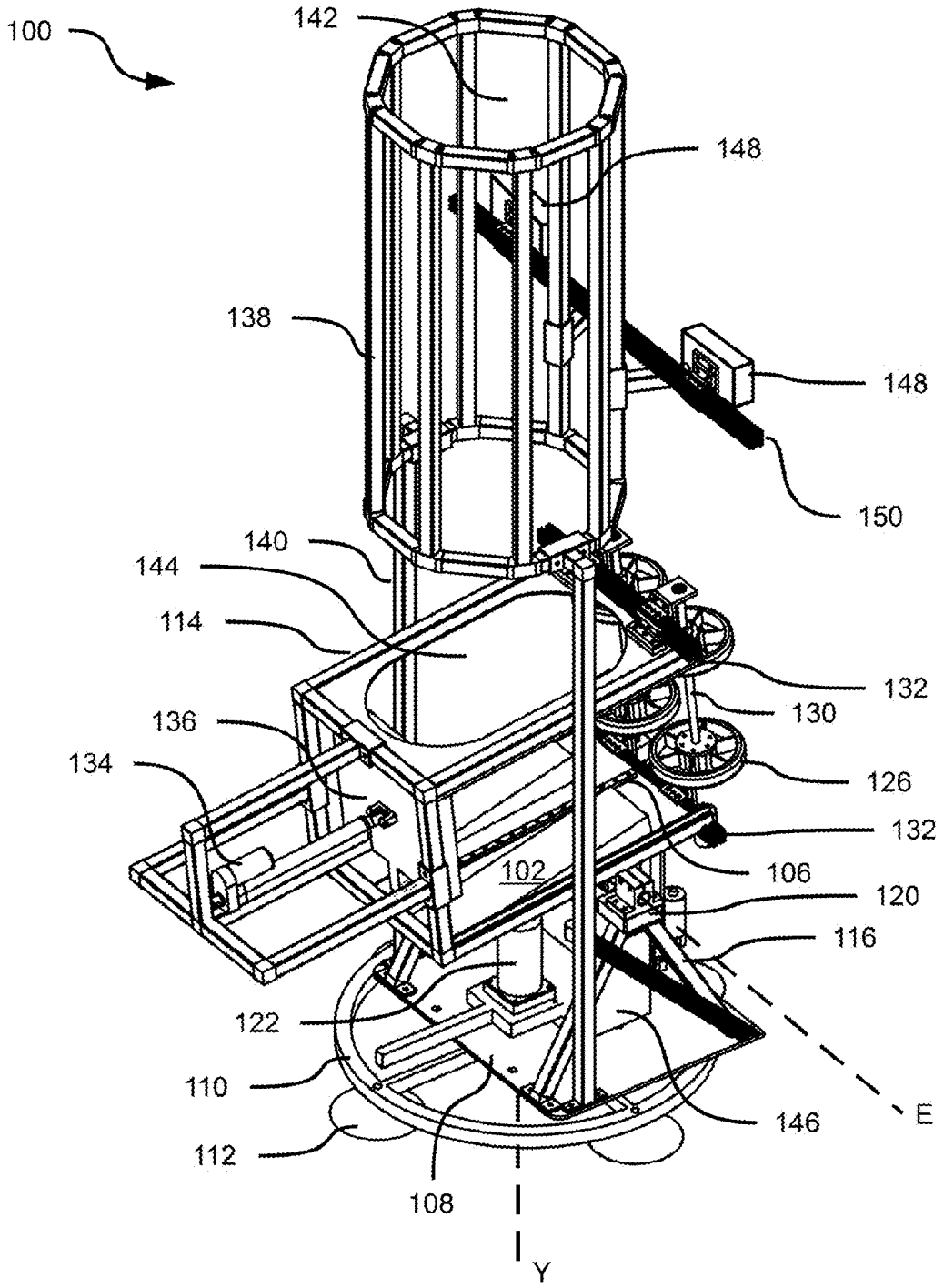
FIG. 1 depicts an isometric view of an automated ball launching system, according to a non-limiting embodiment.

FIG. 1 depicts an automated ball launching system 100, also referred to herein simply as system 100. As will be discussed in detail below, system 100 is configured to automatically detect the position of at least one target in the vicinity of system 100, such as a human player, and under certain conditions, to launch a ball or other object (e.g. a basketball, hockey puck, or the like) based on the position of the target. In some embodiments, system 100 is configured to track the position of the target (i.e. to continuously reposition itself to aim at the target as the target moves).

Figure 2:
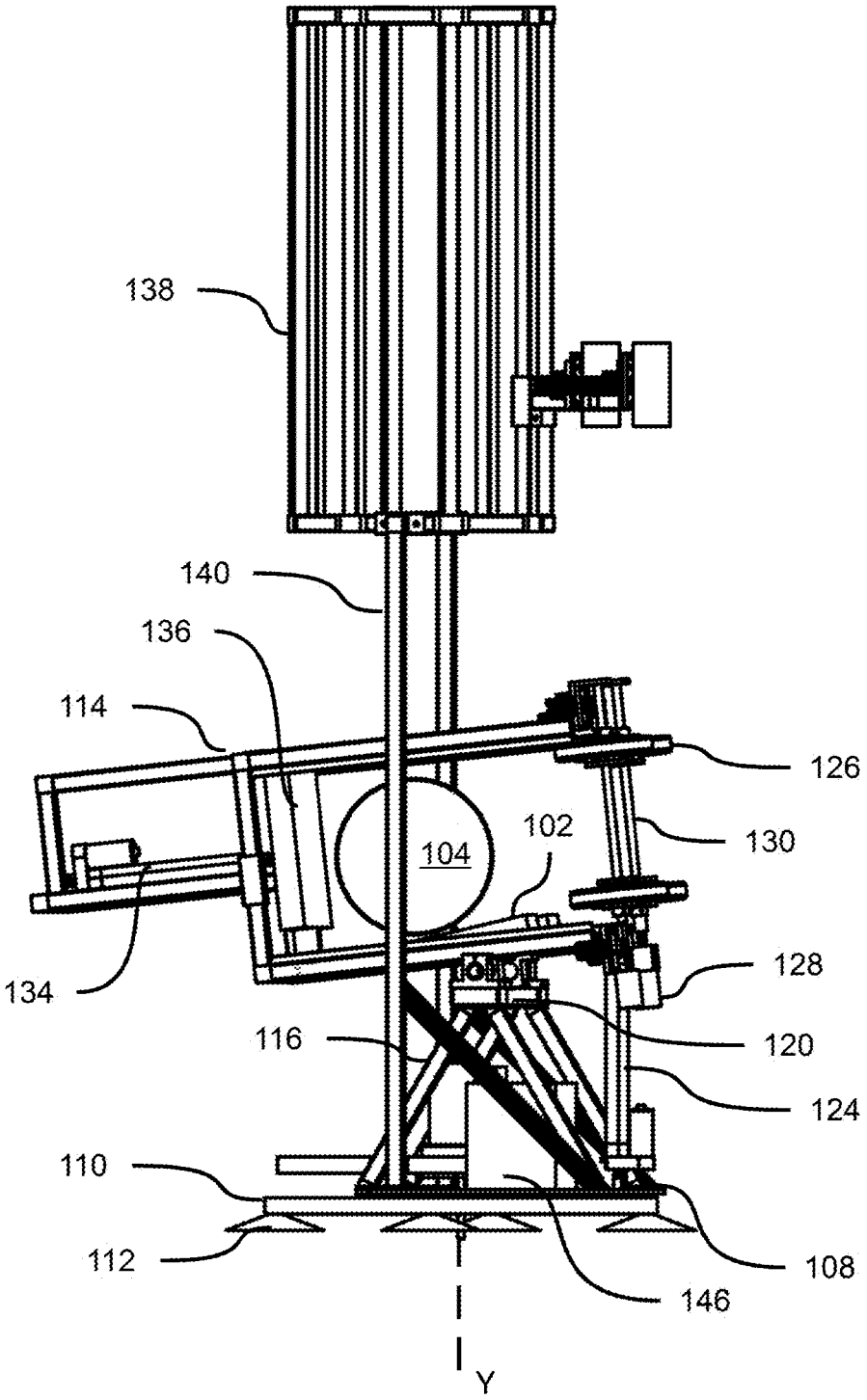
FIG. 2 depicts a side view of the automated ball launching system of FIG. 1, according to a non-limiting embodiment.

Referring to FIGS. 1 and 2, in general, system 100 includes a ball support 102 configured to releasably support a ball 104 in a launch position. Ball 104 is not shown in FIG. 1, but is shown in FIG. 2 in the launch position. The nature of ball support 102 is not particularly limited. Ball support 102 includes one or more surfaces on which ball 104 rests in the launch position. In the embodiment illustrated in FIGS. 1 and 2, ball support 102 includes a pair of substantially planar surfaces separated by a track 106. Ball 104 may therefore rest partially on each planar surface, with a central portion of ball 104 resting between the planar surfaces over track 106 and reducing the likelihood of ball 104 rolling off the planar surfaces.

In other embodiments, a wide variety of other ball supports can be employed. For example, curved guides can be placed on the planar surfaces shown in FIG. 1, having a shape matching the nature of ball 104. In the present example, ball 104 is a basketball, and thus guides may be placed on the planar surfaces with a curvature matching the shape of a basketball. However, in other embodiments, guides with different curvatures may be employed to accommodate larger or smaller balls (or indeed, other projectiles, such as hockey pucks).

System 100 also includes a positioning subsystem configured to set a launch direction for ball 104, and a launcher configured to project ball 104 in the launch direction from the launch position shown in FIG. 2. A variety of positioning systems are contemplated. For example, as will be seen below, ball support 102 itself can be repositioned to define the direction in which ball 104 will be projected. In other embodiments, a moveable channel, baffle or the like can be placed "downstream" of ball 104 to redirect ball 104 upon launch. In still further embodiments, system 100 as a whole can be repositioned to define a launch direction. A variety of launchers are also contemplated. In addition to the launcher discussed in greater detail below, launching mechanisms such as catapults, pistons, pneumatic launchers and the like are contemplated.

In the present embodiment, the positioning system is provided by a set of actuators, and the launcher is provided by motorized wheels, as will be discussed below.

System 100 includes a rotatable base 108, such as a flat plate (e.g. made from steel or any other suitable material, and having sufficient strength to support the weight of the components of system 100 described herein). Base 108 is rotatably mounted on a fixed support, such as a ring 110. Ring 110 can rest directly on the ground when system 100 is in use, or can be supported on the ground by, for example, suction cups 112 or any other suitable support mechanism (e.g. wheels, pegs, or any suitable combination thereof). Base 108 is mounted on ring 110 to allow rotation of base 108 relative to ring 110. Thus, base 108 can include wheels, bearings or the like to move along the surface of ring 110.

In other embodiments, base 108 can simply rest directly on the upper surface of ring 110, without being rotationally fixed to ring 110.

System 100 also includes a launch assembly 114 supported by base 108. In particular, launch assembly 114 is supported on base 108 by a frame 116 and an axle 120. Thus, launch assembly 114 is rotatable relative to base 108 about an elevation axis "E". Meanwhile, as mentioned above base 108 is rotatable relative to ring 110 (and by extension, to the ground on which system 100 is installed) about a yaw axis "Y".

In the present embodiment, the above-mentioned positioning subsystem includes a first actuator for rotating base 108 about axis Y, and a second actuator for rotating launch assembly 114 about axis E. The nature of the first and second actuators is not particularly limited. In the present example, the first actuator is a motor 122 (e.g. a high torque DC electrical motor). Motor 122 can include an axis protruding through an opening in base 108 and fixed to a central portion of ring 110, e.g. by a form arm or other attachment. Motor 112 can also include a casing (visible in FIG. 1) surrounding the above-mentioned axis and fixed to base 108. Thus, when motor 108 operates, the casing of motor 108 rotates about the motor's axis (which is fixed to ring 110), causing base 108 to rotate about axis Y.

The second actuator can include a linear actuator 124, such as a hydraulic or pneumatic cylinder, or an electric actuator, coupled to base 108 at one end and to launch assembly 114 at an opposite end. Thus, the lengthening or shortening of linear actuator 124 causes launch assembly 114 to pivot about axis E. In other embodiments, linear actuator 124 can be replaced, or supplemented, with a rotational actuator mounted adjacent to axle 120.

As seen in FIGS. 1 and 2, launch assembly 114 includes ball support 102, as well as the above-mentioned launcher, in the form of at least one wheel 126, driven by at least one motor 128. In the present embodiment, launch assembly 114 includes two pairs of wheels 126. Each pair of wheels 126 is mounted on a respective shaft 130 driven by a motor 128, such as a DC electric motor. As seen in FIGS. 1 and 2, wheels 126 are mounted at an outlet end of launch assembly 114 (that is, the end of launch assembly 114 from which ball 104 exits launch assembly 114 upon projection by wheels 126). In other embodiments, however, other positions and orientations may be employed for wheels 126. For example, wheels 126 may be mounted at various angles (that is, shafts 130 need not travel from the lower portion to the upper portion of launch assembly 114, as shown in the drawings; shafts 130 also need not be substantially parallel, as shown in the drawings). In other embodiments, wheels 126 can be placed, for example, between the planar surfaces of ball support 102 rather than at the outlet of launch assembly 114.

The positions of wheels 126 can be adjusted in at least one direction. For example, shafts 130 can be slideably mounted on rails 132, such that shafts 130 can be placed closer together or further apart. In addition, where multiple wheels 126 are provided on each shaft 130, the position of the wheels along each shaft 130 can be adjusted. More generally, the positions of wheels 126 at the outlet of launch assembly 114 can be adjusted to accommodate a variety of sizes of ball 104.

As will now be apparent to those skilled in the art, when ball 102 is in the launch position shown in FIG. 2, in order to contact wheels 126 for projection from launch assembly 114, ball 102 must be brought into contact with wheels 126. Launch assembly 114 therefore also includes a feeder actuator 134, such as a linear actuator (e.g. a pneumatic or hydraulic cylinder, or an electric actuator), configured to move ball 104 along ball support 102 and into engagement with wheels 126 (which, as will be discussed below, are configured to spin to drive ball 104 out of launch assembly 114. A push plate 136 or other suitable structure for engaging ball 104 can be mounted at the end of feeder actuator 134 and slideable within launch assembly 114. In other embodiments, however, push plate 136 can be omitted, and the end of feeder actuator 134 itself can engage ball 104 directly. In still other embodiments, a wheel or other friction-reducing structured can be placed on the end of feeder actuator 134.

System 100 can also include a ball dispenser 138 supported by base 108 and disposed above launch assembly 114. In the present example, dispenser 138 is supported above launch assembly 114 by a frame 140, although other support mechanisms are also contemplated. Dispenser 108 can be removable from base 108, or can be omitted entirely in some embodiments.

In general, dispenser 138 defines a channel 142 configured to store a plurality of balls, and is configured to release a ball from channel 142 into launch assembly 114. Channel 142 has a lower end adjacent to launch assembly 114, and an opposite upper end. Balls may be loaded into channel 142 via the upper end, and released from the lower end to fall into launch assembly 114 via an opening 144 in an upper surface of launch assembly 114.

Dispenser 138 can include a dispensing actuator (not shown in FIGS. 1 and 2) to control the release of balls from channel 142 into launch assembly 114. A variety of dispensing actuators can be implemented. An example of a dispensing actuator is shown in FIGS. 3A, 3B and 3C, each of which depicts a simplified illustration of dispenser 138.

Figure 3A:
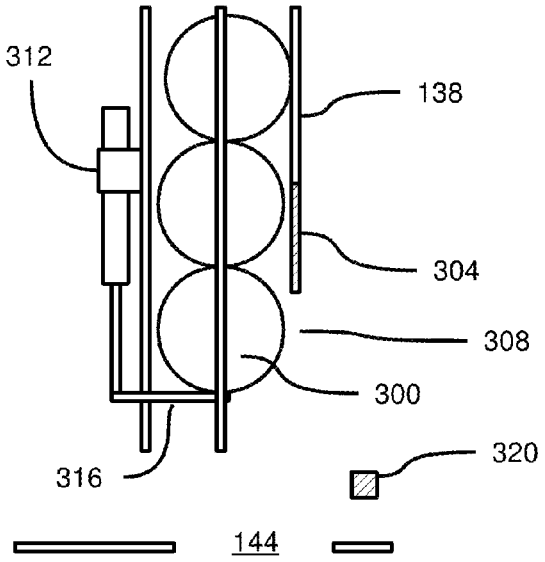
FIGS. 3A, 3B and 3C depict schematic diagrams of a dispenser of the system of FIG. 1, according to a non-limiting embodiment.

FIG. 3A depicts a side view of dispenser 138, in which three balls 300 are stored within channel 142. In the present embodiment, in which channel 142 is formed by a plurality of spaced apart frame members (as seen in FIGS. 1 and 2), a wall portion 304 can be included in between two adjacent frame members. In other embodiments, however, wall portion 304 can be omitted. Further, in other embodiments channel 142 can be provided by a solid tube instead of the frame members shown in the drawings. In general, an opening 308 is defined in the side of channel 142 adjacent the lower end of dispenser 138. In the present example, the opening is defined below wall portion 104. For instance, the frame members supporting wall portion 304 may not extend to the lower end of channel 142.

Dispenser 138 also includes a dispenser actuator 312 in the form of a linear actuator connected to dispenser 138. Actuator 312 includes a projection 316 extending into channel 142. In a first position, shown in FIG. 3A, projection 316 is raised such that the opening 308, between projection 316 and wall portion 304, is too small for a ball 300 to escape dispenser 308. In response to a control signal (to be discussed below in greater detail), actuator 312 can transition to a second, lowered position, shown in FIG. 3B.

Figure 3B:
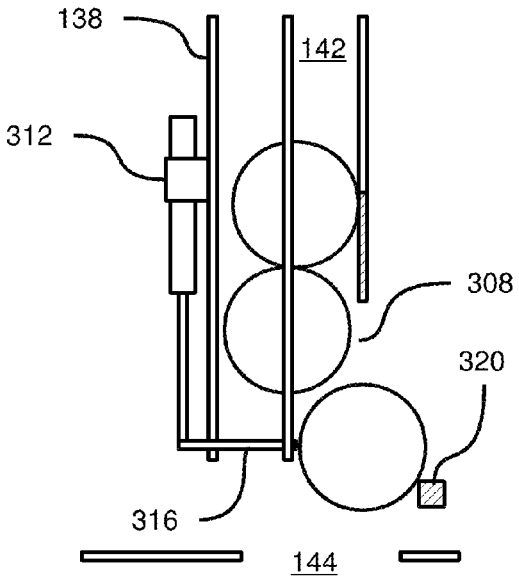
Figure 3C:
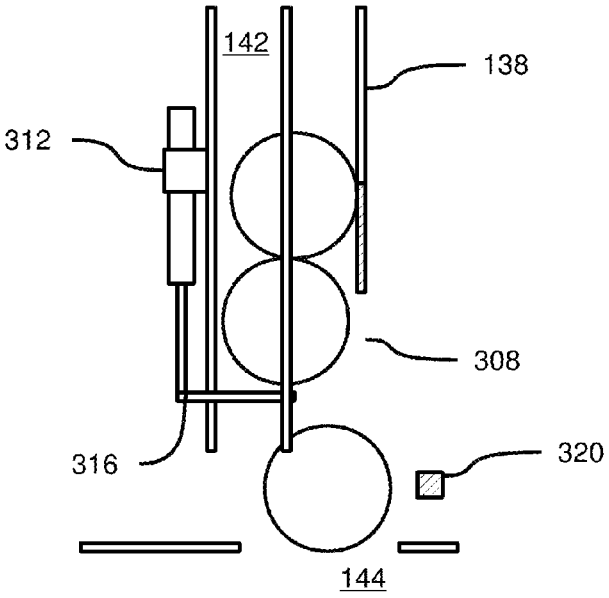

As seen in FIG. 3B, with actuator 312 in the lowered position, opening 308 is enlarged sufficiently for the bottom one of balls 300 to leave channel 142. However, a restraining bar or other structure (coupled to either dispenser 138 or launch assembly 114), in conjunction with the end of projection 316, prevents the ball 300 from falling into opening 144 of launch assembly 114 (only the upper portion of which is shown in FIGS. 3A-3C). In addition, the next ball 300 is prevented from leaving channel 142 by the lowest ball 300.

To release the ball 300 from dispenser 138 and into launch assembly 114, actuator 312 returns to the raised position, as seen in FIG. 3C. Upon returning to the raised position, actuator 312 raises projection 316 sufficiently to allow the lowest ball 300 to fall from restraint 320 into opening 144. Meanwhile, the next ball 300 in channel 142 is prevented from leaving channel 142 due to the reduced size of opening 308. The process shown in FIGS. 3A-3C can be repeated for each ball 300 to be dispensed into launch assembly 114.

A wide variety of other dispensers can be employed in other embodiments. For example, although channel 142 is shown as being substantially straight, in other embodiments channel 142 can have a variety of shapes, such as a helical shape, a zigzag shape, and the like. In further embodiments, channel 142 can be replaced with a hopper-like structure in which a plurality of balls can rest (not necessarily stacked one above the other as shown in FIGS. 3A-3C), and having a tapered lower portion with a gate or other actuator for allowing a single ball to exit the hopper at a time. A variety of other actuator implementations are also contemplated. For example, the dispenser actuator can be provided by one or more actuators configured to open and close the lower end of channel 142. Dispenser 138 can also include collection devices, such as a basketball backboard and basketball net mounted above channel 142. In addition, a collection net around the backboard can also be provided, to collect missed shots (that do not reach the basketball net) and guide balls into channel 142. In still other embodiments, as mentioned above, dispenser 138 can be omitted entirely, and such collection devices can be connected to launch assembly 114 or supported on base 108 above launch assembly 114.

As seen in FIGS. 1, 2 and 3A-3C, certain components of system 100, such as launch assembly 114, frames 116 and 140, and dispenser 138, can be constructed with modular framing elements, such as extruded aluminum beams provided by 80/20™. A wide variety of other configurations and materials are also contemplated, and the above are provided simply by way of example. In the present embodiment, all of the above-mentioned actuators and motors, as well as the control subsystem to be discussed below, are powered by a battery 146 supported on base 108, such as a 12V car battery. In other embodiments, a variety of other power sources, or combinations of power sources, can be implemented.

Although not shown in FIGS. 1 and 2, system 100 also includes a control subsystem connected to the positioning subsystem and the launcher. In general, the control subsystem is configured to determine a position of a target (e.g. a human player) relative to system 100, to control the positioning subsystem to set the launch direction based on the position of the target, and to control the launcher to project ball 104 in the launch direction. Thus, in the context of the embodiment shown in FIGS. 1, 2 and 3A-3C, the control subsystem is configured to control actuators 122 and 124 to set a launch direction by positioning base 108 and launch assembly 114. The control subsystem is also configured to control dispenser 138 (e.g. actuator 312) to dispense a ball into launch assembly 114. Further, the control subsystem is configured to control motors 128 to drive shafts 130 (and by extension, wheels 126), and to control actuator 134 to push ball 104 into engagement with wheels 126 for projection from launch assembly 114.

Figure 4:
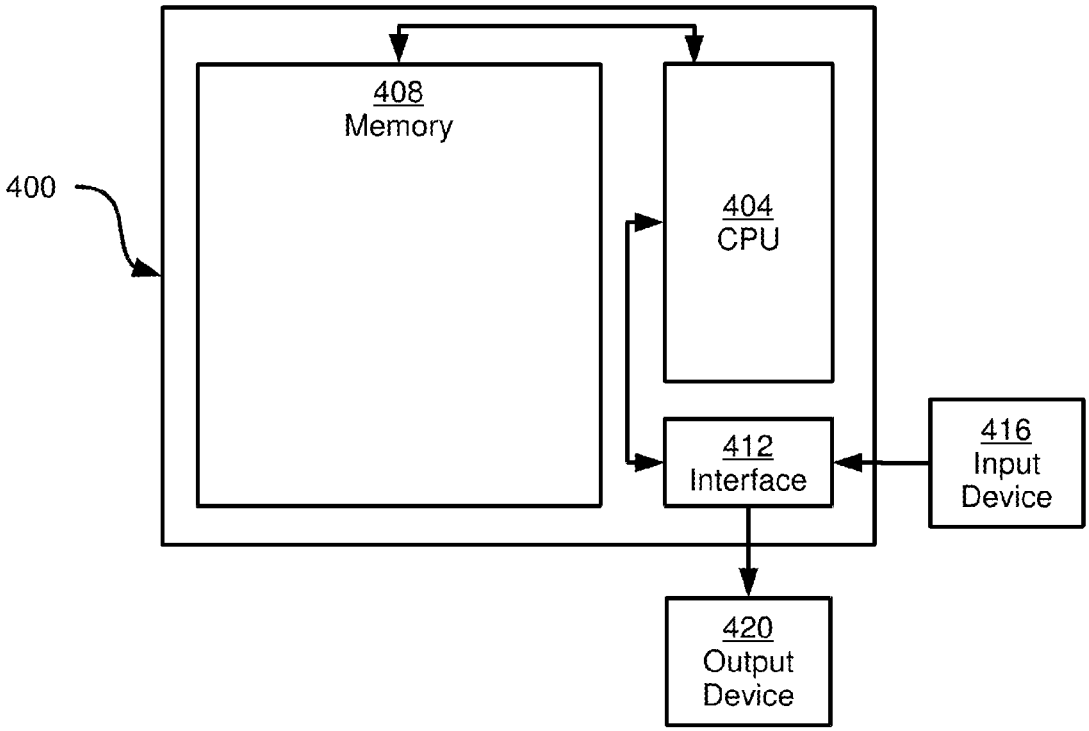
FIG. 4 depicts a computing device for controlling the system of FIG. 1, according to a non-limiting embodiment.

Referring now to FIG. 4, the control subsystem includes at least a computing device 400, which can be any of a wide variety of suitable computing devices, such as a desktop computer, a laptop computer, a tablet computer, and the like. In some examples, computing device 400 can be a computing platform such as a Jetson TK1, manufactured by NVIDIA™. Computing device 400 can be mounted on system 100, for example on base 108, or can be maintained separately from system 100 (although with a communications link to system 100).

Generally, computing device 400 includes a central processing unit (CPU) 404, also referred to herein as processor 404, interconnected with a memory 408. Memory 408 stores computer readable instructions executable by processor 404, and processor 404 is configured to perform various actions (discussed below) via execution of those instructions. Processor 404 and memory 408 are generally comprised of one or more integrated circuits (ICs), and can have a wide variety of structures, as will now occur to those skilled in the art. For example, processor 404 can include more than one CPU; processor 404 can also include one or more CPUs as well as one or more graphics processing units (GPUs), or any other suitable processing components.

As mentioned above, processor 404 executes the instructions stored in memory 408 to perform, in conjunction with the other components of computing device 400, various functions related to the control of system 100. In the discussion below of those functions, computing device 400 is said to be configured to perform those functions—it will be understood that computing device 400 is so configured via the processing of the instructions in memory 408 by the hardware components of computing device 400 (including processor 404 and memory 408).

Computing device 400 also includes a communications interface 412 interconnected with processor 404, which allows computing device 400 to communicate with other devices, such as the actuators of system 100 described above, as well as other computing devices. Interface 412 thus includes the necessary hardware, such as interface controllers and the like, to communicate with such other devices. As will be seen further below, interface 412 may enable computing device 400 to connect to one or more additional computing devices, which in turn communicate with the actuators of system 100 (rather than computing device 400 itself communicating directly with the actuators of system 100).

Computing device 400 can also include one or more input devices 416 interconnected with processor 404. Example input devices include keyboards, mice, touch screens, touch-sensitive wearable devices such as armbands, and the like. Input device 416 can be connected to processor 404 via interface 412 by any of a variety of connection types, including universal serial bus (USB), Bluetooth™ and the like. Input device 416 can also be connected to a separate computing device, and commands can be relayed to processor 404 via such other computing device rather than received at processor 404 directly from input device 416.

Computing device 400 can also include one or more output devices 420 interconnected with processor 404. Example output devices include a display, speaker, and the like. As shown in FIG. 4, output device 420 can be connected to processor 404 via interface 412, via a connection such as a digital visual interface (DVI) connection. As with input device 416, output device 420 can also be a component of a separate computing device, and can therefore be connected to processor 404 via the processor and communications interface of the other device.

Figure 5:
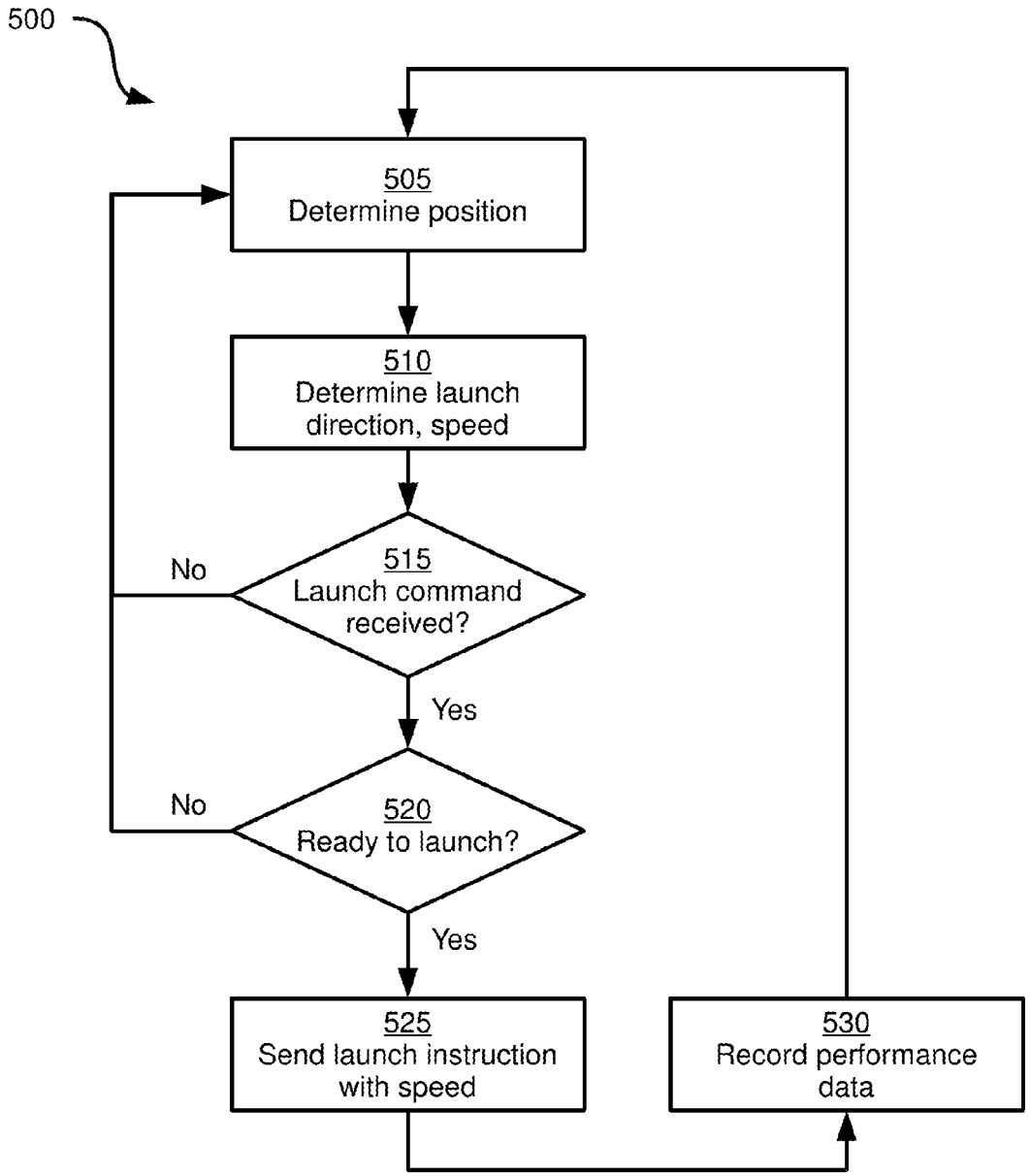
FIG. 5 depicts a method of controlling an automated ball launching system, according to a non-limiting embodiment.

Turning now to FIG. 5, a method 500 of controlling an automated ball launching system, such as system 100, is depicted. The blocks of method 500 are performed by computing device 400, and more specifically by processor 404, via the execution of instructions stored in memory 408.

At block 505, computing device 400 is configured to determine a position of a target relative to system 100. In the present example, the target is assumed to be a human player (e.g. employing system 100 as a basketball training tool). In other examples, however, the target need not be a human player. A variety of mechanisms can be employed to determine the position of the target.

Figure 6:
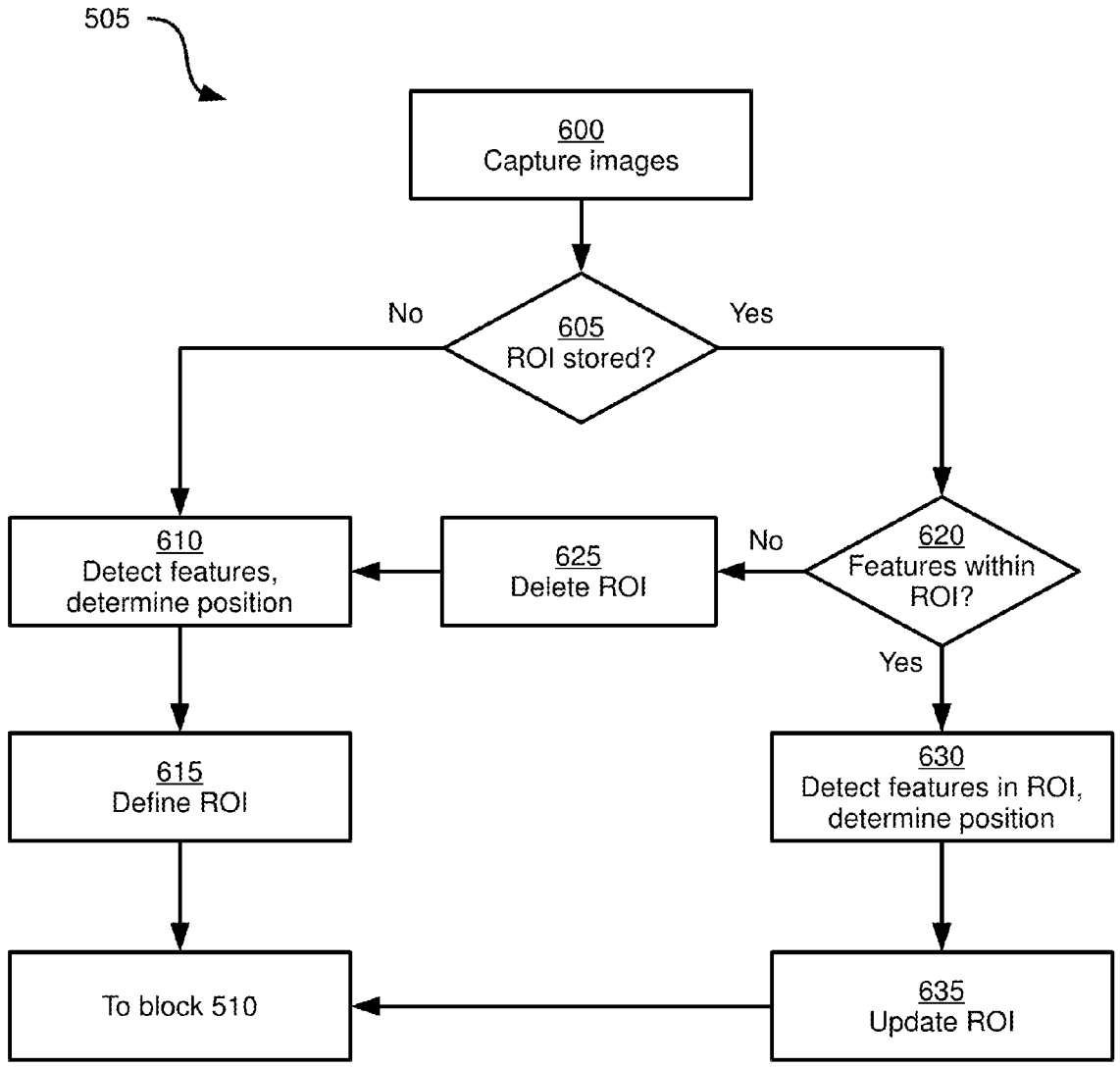
FIG. 6 depicts a method of determining the position of a target in block 505 of the method of FIG. 5, according to a non-limiting embodiment.

In the present embodiment, computing device 400 is configured to perform block 505 via a method shown in FIG. 6. As seen in FIG. 6, at block 600 computing device 400 captures a pair of images of the environment surrounding system 100. For example, cameras 148 (e.g. Logitech™ c920 webcams) can each provide a video stream to computing device 400, and the images captured at block 600 can include a frame from each video stream. Referring briefly to FIG. 1, system 100 can include a stereoscopic pair of cameras 148 adjustably mounted on a rail 150. In other embodiments, cameras 148 need not be connected directly to system 100, but rather can be mounted at any suitable location, provided that sufficient distance is placed between cameras 148 to allow for determination of target depth by comparing the images from each camera 148, and provided that the position of cameras 148 relative to each other and relative to system 100 is known.

Figure 7A:
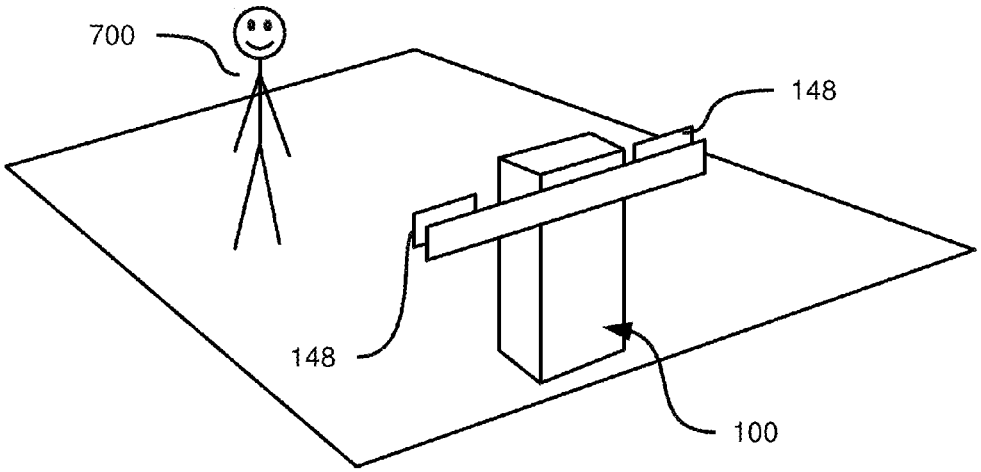
FIGS. 7A and 7B depict the capture of images of a target player in the method of FIG. 6, according to a non-limiting embodiment.
Figure 7B:
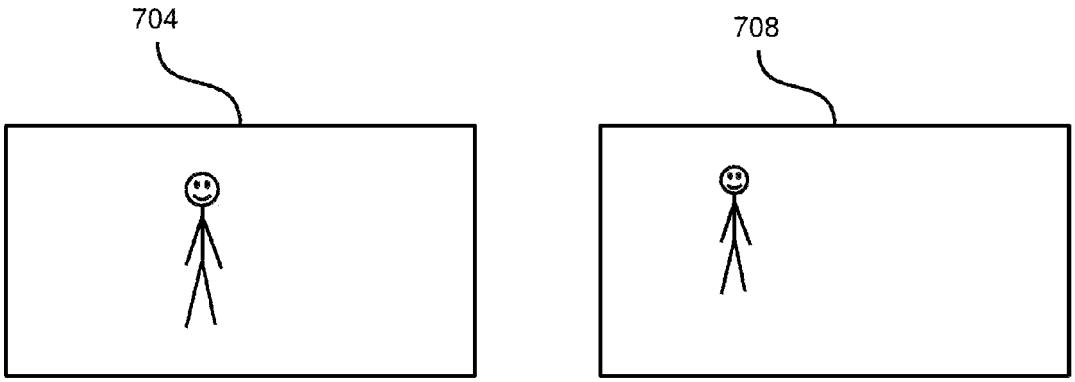

Turning to FIG. 7A, an example target 700 is shown in the vicinity of system 100. Cameras 148 are configured to each capture an image of target 700 and provide the images to computing device 400. FIG. 7B depicts example images 704 and 708 captured by cameras 148.

Returning to FIG. 6, computing device 400 can be configured to determine whether a region of interest is stored in memory 408. The region of interest identifies a portion of each image 704, 708 based on a previously detected location of target 700 within images 704 and 708. In the present example, the determination at block 605 is assumed to be negative, and thus computing device 400 proceeds to block 610. At block 610, computing device 400 detects predetermined features of target 700 in images 704 and 708, and based on a comparison of images 704 and 708, determines the position of target 700 relative to system 100.

The features detected at block 610 are not particularly limited. In general, features are selected that permit computing device to detect target 700 within images 704 and 708 and to determine a position of target 700. When target 700 is a human player, for instance, the features detected at block 610 can include face detection, body detection and the like. Any suitable detection algorithms can be implemented. For example, the Haar cascade algorithm (e.g. as implemented in the OpenCV library) can be applied to images 704 and 708 for face detection. Other suitable algorithms will also occur to those skilled in the art.

Having detected the above-mentioned features of target 700 in each image, computing device 400 is configured to determine the position, in three dimensions, of target 700 relative to system 100. For example, computing device 400 can transform the locations of the detected features within images 704 and 708 into rays in three-dimensional space, based on the known relative positions of cameras 148. By determining the intersection of the two rays thus generated, computing device 400 can determine the position (including depth) of target 700.

Figure 8:
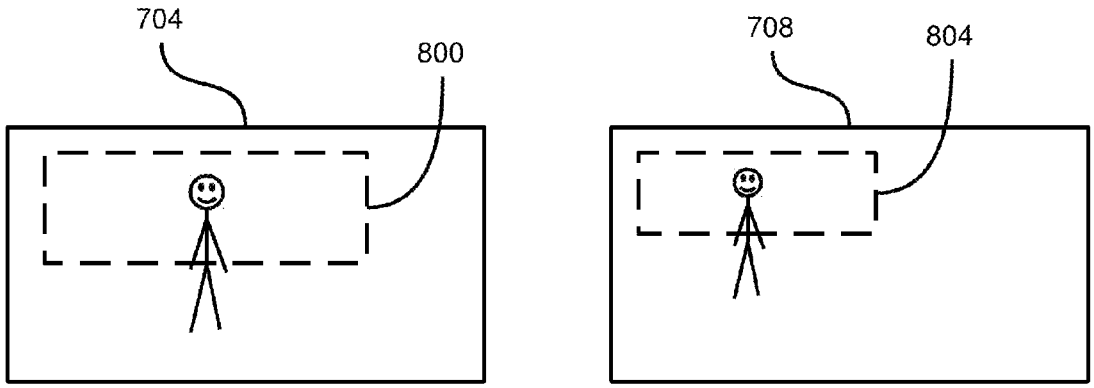
FIG. 8 depicts regions of interest determined based on the images captured in the method of FIG. 6, according to a non-limiting embodiment.

Having determined the position of target 700, computing device 400 can be configured, at block 615, to define a region of interest to be applied to the next frames received from cameras 148. For example, computing device 400 can generate a ROI based on a predicted maximum distance that target 700 will travel before the next images are received. Referring to FIG. 8, ROIs 800 and 804, defined based on images 704 and 708, are illustrated. It will be understood that ROIs 800 and 804 are not portions of images 704 and 708 specifically, but rather define portions of any images received from cameras 148 (e.g. by coordinates). Assuming that the face of target 700 is detected at block 610, ROIs 800 and 804 represent the maximum possible range of travel of the target 700's face before the next pair of images are received from cameras 148.

Having defined an ROI, computing device returns to the performance of method 500 at block 510. When, on the other hand, the determination at block 605 is affirmative (e.g. when ROIs 704 and 708 were already defined), computing device 400 proceeds to block 620 rather than block 610. At block 620, computing device 400 is configured to determine whether the above-mentioned features can be detected within the ROIs, rather than within the entire images received from cameras 148. When the determination at block 620 is affirmative, the position of target 700 is determined based on the detected features at block 630 (as described above in connection with block 610), and the ROIs can be updated based on the position determined at block 630 at block 635.

When the determination at block 620 is negative, this indicates that the target 700 has moved further than expected, and that the entire images are to be searched for detectable features, rather than only the ROIs. Thus, computing device 400 is configured to discard the previous ROIs at block 625, and perform block 610 as discussed above. In some embodiments, the use of ROIs can be omitted entirely (e.g. where computational performance is great enough to continuously support full image feature detection).

A variety of other position-determination processes can be employed by computing device 400. For example, rather than relying on stereoscopic cameras 148, computing device 400 can receive a single image (from a single camera), and accompanying depth data, e.g. from a depth scanner such as a LIDAR device, an ultrasonic sensor, or the like. In other embodiments, the depth scanner can be omitted, and computing device 400 can perform a height calibration process on an image received from a monocular camera to determine the depth of target 700 in the image. In still other embodiments, a motion tracking system, for example based on infrared or near-infrared reflectors on target 700 and corresponding cameras connected to computing device 400, can be implemented. Additional motion tracking systems, such as active infrared or near-infrared (in which target 700 is equipped with IR-emitters rather than reflectors) can also be employed. In still other embodiments, location sensors such as GPS receivers worn by target 700 may be employed to determine the position of target 700, and supply the position to computing device 400.

Returning to FIG. 5, having determined the position of target 700, computing device 400 is configured to determine a launch direction and speed for ball 104 based on the target position. In the embodiments discussed herein, the launch direction and speed are determined in order to launch ball 104 as close as possible to target 700. In other embodiments, however, ball 104 need not be aimed at target 700. Instead, ball 104 can be aimed a predetermined distance away from target 700, for example.

In connection with system 100 as discussed above, the determination at block 510 involves determining a yaw angle (that is, an angle about axis Y) and an elevation angle (that is, an angle about axis E), as well as a speed for wheels 126 required to propel ball 104 a sufficient distance to reach target 700. In some embodiments, the launch direction and speed can be determined based on known relationships between the speed of wheels 126 and the speed of ball 104 when projected by wheels 126. In other embodiments, launch directions and speeds required to project ball 104 by predetermined distances can be measured or calculated in advance and stored in memory 408, for example in a lookup table. In the present embodiment, memory 408 stores a lookup table containing the required elevation angles and corresponding wheel speeds to achieve projection distances of between two and six meters, at half-meter intervals. Thus, at block 510 computing device 400 is configured to set the yaw angle to point the outlet of launch assembly 114 at target 700, and to retrieve the elevation angle and speed from the above-mentioned lookup table based on the distance between system 100 and target 700 (interpolating between lookup table intervals if necessary).

The angles and speed determined at block 510 can be determined and provided to system 100 in any suitable format (e.g. angles, voltages, and the like).

At block 510, computing device 400 can also be configured to send the launch direction to the positioning subsystem, for controlling the positioning subsystem to place launch assembly 114 in the launch direction while the remainder of method 500 is performed. In some embodiments, this can be omitted, and system 100 can instead remain at rest until a launch is required.

At block 515, computing device 400 is configured to determine whether a launch command has been received. The launch command can be received, for example from input device 416. A variety of launch commands are contemplated. For example, an input provided by target 700 to a touch screen, a wearable armband with a touch-sensitive input, and the like, can be employed. In other embodiments, input device 416 can include a microphone, and the launch command can be an audible command (e.g. the word "go" spoken by target 700). In still other embodiments, the launch command can be generated by computing device 400 itself, for example upon determining that the location of target 700 has remained stationary (or has shifted by less than a threshold amount) for a predetermined period of time. The launch command can also include one or more gestures performed by target 700 and identified by computing device 400 from series of images received from cameras 148.

When no launch command is received, the performance of method 500 returns to block 505, and system 100 continues to track the current position of target 700. When a launch command has been received, however, the performance of method 500 proceeds from block 515 to block 520. At block 520, computing device 400 is configured to determine whether various safety conditions are met. For example, computing device 400 can be configured to determine whether target 700 is at or beyond a minimum distance (e.g. two meters) from system 100, and whether the current launch direction is within a predetermined margin of the current location of target 700 (e.g. ten degrees). In some embodiments, the performance of block 520 can be omitted.

When the determination at block 520 is negative, the performance of method 500 returns to block 505, and system 100 continues to track the position of target 700 (noting that, since a pending launch command has not yet been executed, the determination at block 515 will be affirmative until a launch has been performed). In other embodiments, an error may be generated. For example, the launch command received at block 515 may be discarded and a warning indication (e.g. a flashing light) may be generated, before returning to block 505.

When the determination at block 520 is affirmative (or when block 520 is not implemented), computing device 400 proceeds to block 525. At block 525, computing device 400 is configured to send a launch instruction to system 100. The launch instruction can include the speed determined at block 510, for controlling motors 128 to spin wheels 126 up to the required speed. In some embodiments, the launch instruction can also include an instruction to feeder actuator 134 to extend to push ball 104 into engagement with wheels 126.

In embodiments including dispenser 138 or a similar dispenser, at block 525, computing device 400 can also send an instruction to dispenser 138 to supply the next ball to launch assembly 114. Although not required, the instruction to dispenser 138 can be delayed until confirmation of a successful launch is received (e.g. a speed decrease measured at wheels 126 due to contact with ball 104, or the detection of ball 104 in subsequent images from cameras 148).

Following the performance of block 525, at block 530 computing device 400 can record various performance data For example, computing device 400 can store, in memory 408, the location of target 700 at the time of the launch. Computing device 400 can also, subsequent to the launch, receive input data indicating whether a shot has been taken by target 700 (e.g. whether ball 104 has been returned towards system 100 since the launch of ball 104 at block 525). The time elapsed between the launch and the shot can be stored in memory 408. The input data can be received from input device 416, or can be generated by computing device 400, for example by tracking the position of ball 104 in images from cameras 148. Further, computing device can receive input data indicating whether the above-mentioned shot was a hit or a miss (e.g. whether ball 104 was successfully returned to dispenser 138 via a net and backboard). Such input data can be received from input device 416, or from sensors (not shown) mounted in or near dispenser 138.

Figure 9:
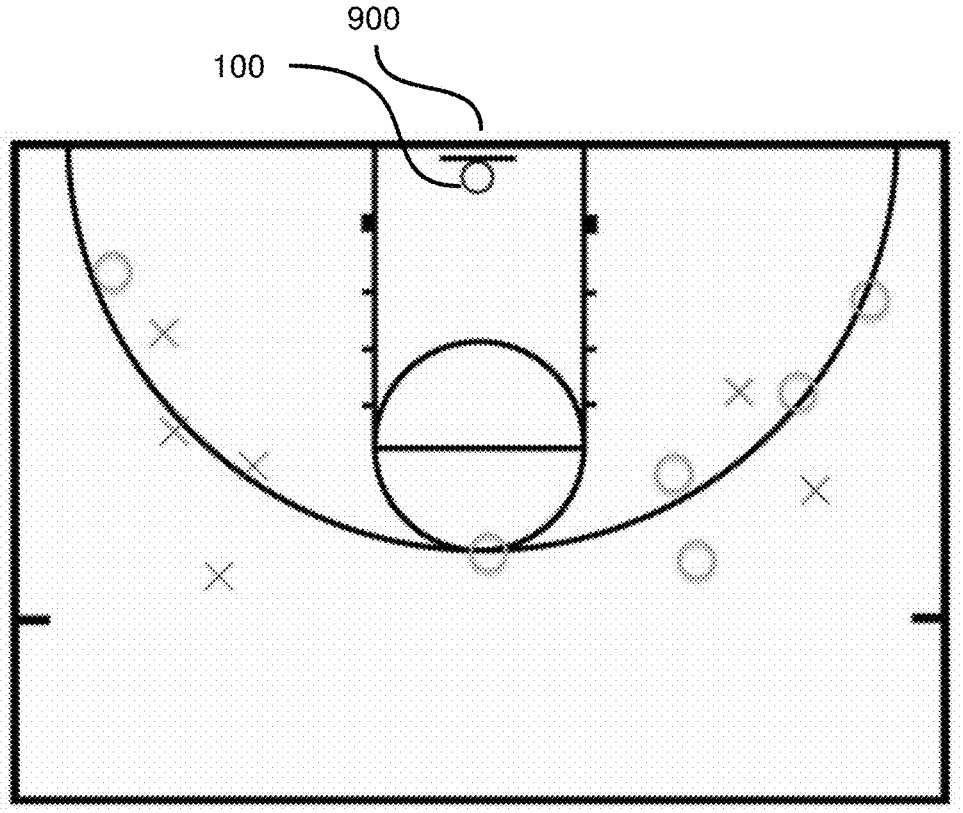
FIG. 9 depicts the display of performance data recorded in the method of FIG. 5, according to a non-limiting embodiment.

Computing device 400 can be configured to present some or all of the data stored at block 530 on output device 420 (e.g. a display). For example, referring to FIG. 9, a representation 900 of shots taken by target 700 at system 100 from various locations in the vicinity of system 100 is shown, as presented on a display. Each shot is marked by an "x" or an "o", indicating misses and hits, respectively (though this depiction is not mandatory).

Computing device 400 can also be configured to generate a variety of additional feedback for target 700 (when target 700 is a player). For example, computing device 400 can be configured to identify locations or groups of locations from which the player is more or less likely to miss shots. Computing device 400 can also, based on successive positions determined at block 505, compute a total distance traveled by target 700 and display that distance (in some instances, along with estimated calorie burn information and the like).

Various other embodiments are contemplated for the control subsystem. For example, in some embodiments the control activities performed by computing device 400 above can be divided among more than one device, or can be supplemented by functions performed by other devices.

Figure 10:
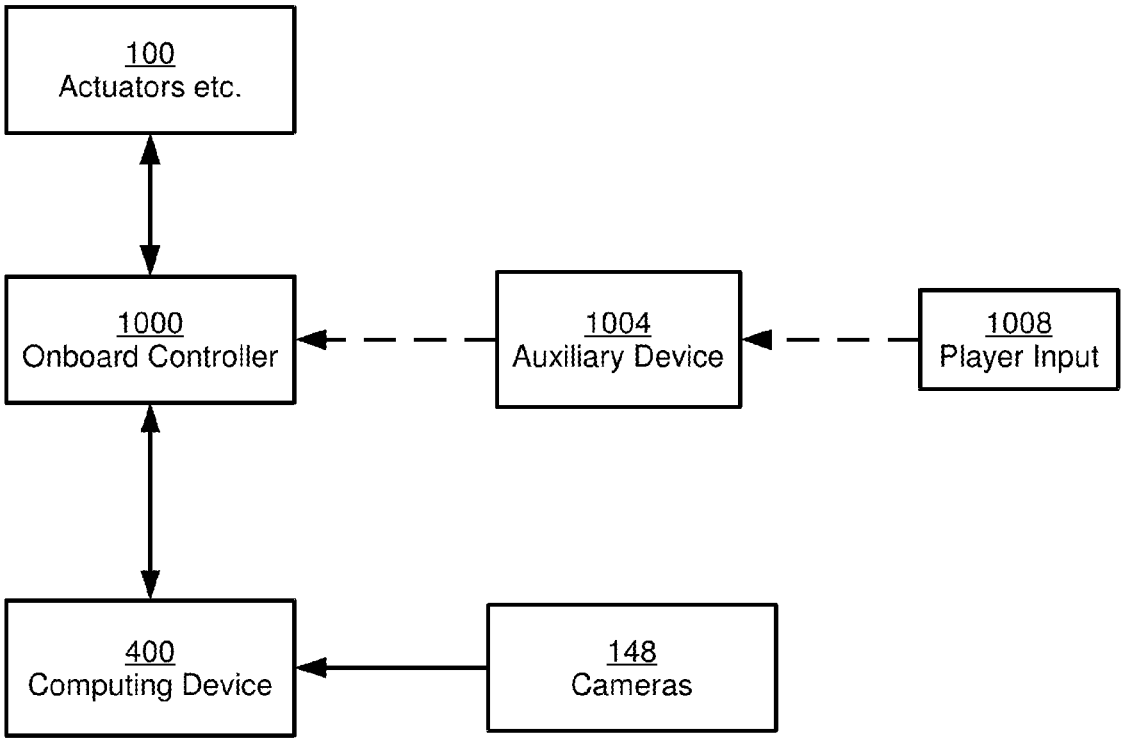
FIG. 10 depicts a control subsystem of the system of FIG. 1, according to a non-limiting embodiment.

Turning to FIG. 10, an example implementation of the control subsystem is illustrated. In addition to computing device 400, the control subsystem includes an onboard controller 1000 (e.g. an Arduino Mega board, although any suitable computing device may be employed) connected to computing device 400 and to the components of system 100 (e.g. actuators, motors and the like, with the exception of cameras 148, which are connected directly to computing device 400). The control subsystem can also include an auxiliary computing device 1004, such as a tablet computer, connected wirelessly to controller 1000. Further, the control subsystem can include a player input 1008, such as the above-mentioned armband.

In the embodiment of FIG. 10, blocks 505 and 510 of method 500 are performed by computing device 400 as described above. However, rather than sending the launch direction directly to the actuators of system 100, computing device 400 is configured to send the launch direction to controller 1000, which then controls the actuators of system 1000, for example by implementing closed loop control (e.g. one or more digital PID controllers) of elevation angle, yaw angle and the like). At block 515, computing device 400 is configured to check a flag in memory 408 indicating the readiness of system 100 to perform a launch. The launch command itself can be generated by player input 1008, and relayed (e.g. wirelessly via Bluetooth™) to auxiliary device 1004 and then (e.g. wirelessly via Bluetooth™) to controller 1000. In response to receiving the launch command, controller 1000 can set the above-mentioned flag in memory 408.

The transmission of a launch instruction at block 525 can therefore include sending the speed determined at block 510 from computing device 400 to controller 1000 rather than directly to the actuators of system 100. Controller 1000 can then be configured to implement the launch instruction, for example by controlling motors 128, and instructing feeder actuator 136 to push ball 104 into engagement with wheels 126, as well as instructing dispenser 138 to release the next ball into launch assembly 114.

As will now be apparent to those skilled in the art, since launch commands are passed through auxiliary device 1004, auxiliary device 1004 can perform block 530, rather than computing device 400.

Further variations to the above are contemplated. For example, motors 128 can be controlled to spin each pair of wheels 126 shown in FIG. 1 at different speeds, rather than at the same speed, in order to impart a curve to the trajectory of ball 104. In addition, the components of system 100 (e.g. launch assembly 114 and dispenser 138) can be modular, for easier replacement and transportation. Additional variants will also occur to those skilled in the art.

The scope of the claims should not be limited by the embodiments set forth in the above examples, but should be given the broadest interpretation consistent with the description as a whole.

We claim:

1. An automated ball launching system, comprising:

a ball support configured to releasably support a ball in a launch position;

a positioning subsystem configured to set a launch direction for the ball;

a launcher configured to project the ball in the launch direction from the launch position;

a ball dispenser including:

a channel for storing a plurality of balls, disposed above the ball support and the launcher and having a lower wall opening;

a restraining member disposed between the lower wall opening and the ball support;

a dispensing actuator including a projection within the channel having (i) a lowered position configured to release one of the plurality of balls from the channel via the lower wall opening, and to engage the one of the plurality of balls between the projection and the restraining member, and (ii) a raised position configured to disengage the projection from the one of the plurality of balls and permit the one of the plurality of balls to fall from the restraining member onto the ball support; the projection configured in the raised position to obstruct the lower wall opening and retain a remainder of the plurality of balls within the channel;

a control subsystem connected to the positioning subsystem and the launcher;

the control subsystem configured to:

control the dispensing actuator to release a ball onto the ball support;

determine a position of a player relative to the ball launching system;

control the positioning subsystem to set the launch direction based on the position of the player; and control the launcher to project the ball in the launch direction.

2. The automated ball launching system of claim 1, further comprising:

a rotatable base;

a launch assembly rotatably mounted on the rotatable base, the launch assembly including the ball support and the launcher;

the positioning subsystem including a first actuator for rotating the base about a first axis, and a second actuator for rotating the launch assembly relative to the base about a second axis perpendicular to the first axis.

3. The automated ball launching system of claim 2, wherein the launcher includes at least one wheel driven by a motor.

4. The automated ball launching system of claim 3, wherein the launcher includes at least two wheels driven by respective motors and mounted at an outlet of the launch assembly.

5. The automated ball launching system of claim 4, wherein each of the at least two wheels is mounted on a respective shaft;

the launch assembly including a rail adjacent to the outlet;

the shafts slideably mounted on the rail.

6. The automated ball launching system of claim 3, the launch assembly including a feeder actuator configured to move the ball along the ball support into engagement with the at least one wheel;

the control subsystem configured to control the feeder actuator and the at least one wheel to project the ball.

7. The automated ball launching system of claim 6, the feeder actuator including a linear actuator.

8. The automated ball launching system of claim 6, the control subsystem including a computing device having a processor and a communications interface, the processor configured to:

determine the position of the player;

based on the position of the player, determine a yaw angle, an elevation angle and a speed; and send the yaw angle and elevation angle via the communications interface for controlling the first actuator and the second actuator of the positioning system, respectively.

9. The automated ball launching system of claim 8, the processor further configured to repeat the determination of the position and the yaw angle, elevation and speed until a launch command is received;

the processor further configured, when a launch command is received, to send a launch instruction including the speed via the communications interface for controlling the at least one wheel.

10. The automated ball launching system of claim 9, the processor configured to determine the position of the player by:

receiving an image from each of a plurality of cameras;

detecting the player in each of the images; and based on the location of the detected player in each image, determining the position of the player relative to the automated ball launching system.

11. The automated ball launching system of claim 10, further comprising:

a rail connected to the ball dispenser for supporting the plurality of cameras.

12. The automated ball launching system of claim 11, the control subsystem further including:

an onboard controller connected to the computing system, the first actuator, the second actuator, the motors and the feeder actuator;

a player input connected to the onboard controller;

the computing device configured to send the yaw and elevation angles to the onboard controller.

13. The automated ball launching system of claim 12, the onboard controller configured to receive the launch command from the player input and relay the launch command to the computing device.

14. The automated ball launching system of claim 13, the onboard controller configured to relay the launch command to the computing device by setting a flag in a memory of the computing device.

15. The automated ball launching system of claim 14, the computing device configured to perform at least one safety check in response to the setting of the flag and before sending the launch instruction.

16. The automated ball launching system of claim 15, the control subsystem further comprising:

an auxiliary computing device connected to the player input and the onboard controller;

the onboard controller configured to receive the launch command from the player input via the auxiliary device.

17. The automated ball launching system of claim 16, the auxiliary computing device configured to record the launch command and the determined position of the player.

* * * * *